US006257029B1

(12) United States Patent
Liao

(10) Patent No.: US 6,257,029 B1
(45) Date of Patent: Jul. 10, 2001

(54) COMPUTER LOCK HAVING DOUBLE LOCKING LEAVES

(76) Inventor: Ming-Pang Liao, 4F, No. 1, Lane 33, Yen-Feng Street, Tu-Cheng City, Taipei Hsien (TW)

( * ) Notice: Subject to any disclaimer, the term of this patent is extended or adjusted under 35 U.S.C. 154(b) by 0 days.

(21) Appl. No.: 09/479,383

(22) Filed: Jan. 5, 2000

(51) Int. Cl.[7] ..... E05B 69/00
(52) U.S. Cl. ..... 70/58; 70/14; 70/57; 248/551
(58) Field of Search ..... 70/14, 18, 19, 70/57, 58; 248/551–553

(56) References Cited

U.S. PATENT DOCUMENTS 5,327,752 * 7/1994 Myers et al. ..... 70/58
5,381,685 * 1/1995 Carl et al. ..... 70/14 X
5,502,989 * 4/1996 Murray, Jr. et al. ..... 70/58
5,673,573 * 10/1997 Green ..... 70/14
5,791,171 * 8/1998 Kelley ..... 70/58
5,913,907 * 6/1999 Lee ..... 70/14 X
5,983,679 * 11/1999 Reyes ..... 70/58
6,006,557 * 12/1999 Carl et al. ..... 70/58
6,038,891 * 3/2000 Zeren et al. ..... 70/58
6,058,744 * 5/2000 Ling ..... 70/58 X
6,112,562 * 9/2000 Murray, Jr. et al. ..... 70/18 X

* cited by examiner

*Primary Examiner*—Suzanne Dino Barrett

(57) ABSTRACT

A computer lock includes a housing (1) having a pair of locking leaves (3) respectively pivotally secured on a front end portion of the housing (1) with the two locking leaves (3) combinably flattened to be inserted through a computer slot (A), and an actuating device (2) slidably held in the housing (1) to be locked in the housing, whereby upon a forward pushing of the actuating device (2) to openly bias the two locking leaves (3) for extending the two leaves (3) to be retarded against the sidewall extension disposed around the computer slot, the computer will then be stably locked with the two locking leaves (3) of the computer lock.

11 Claims, 7 Drawing Sheets

FIG. 5
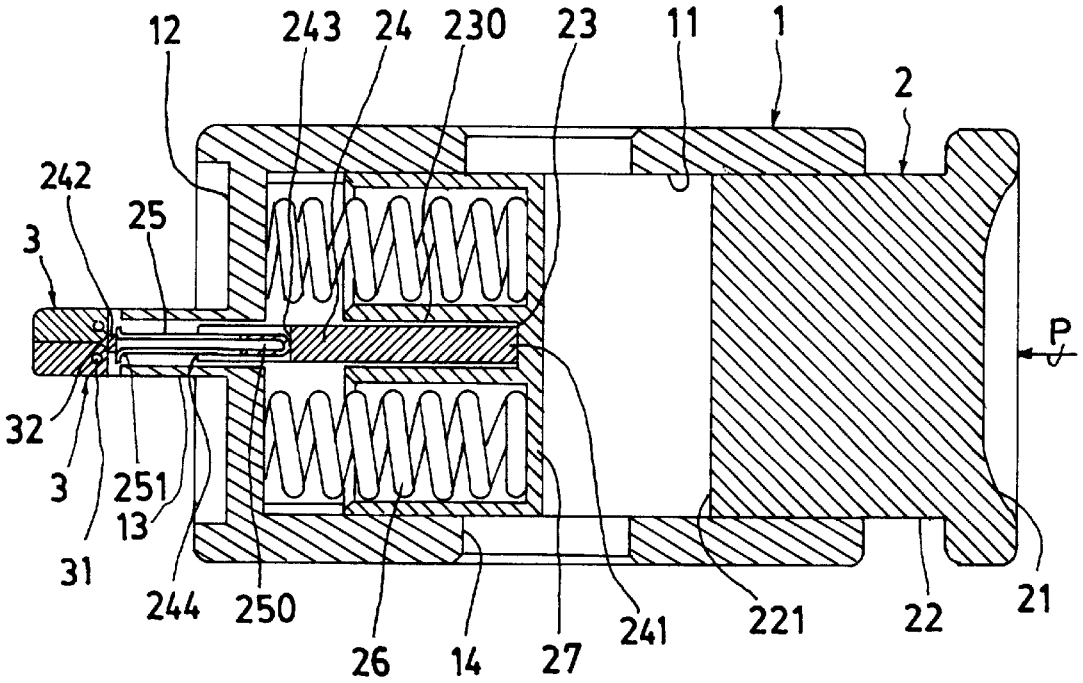
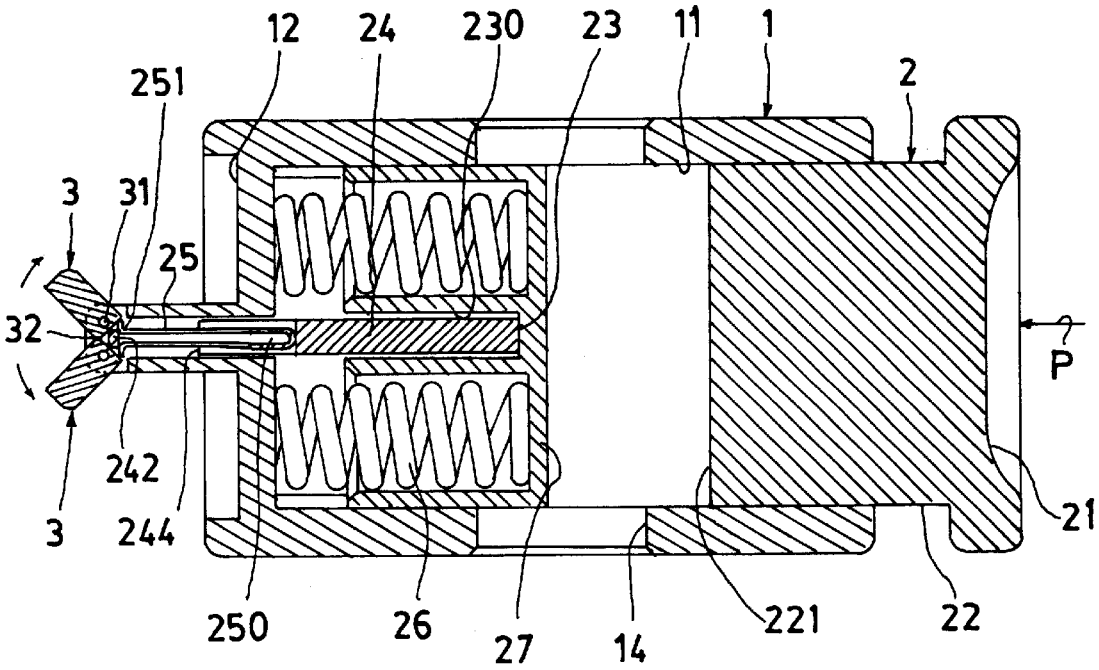
FIG. 6

FIG. 11
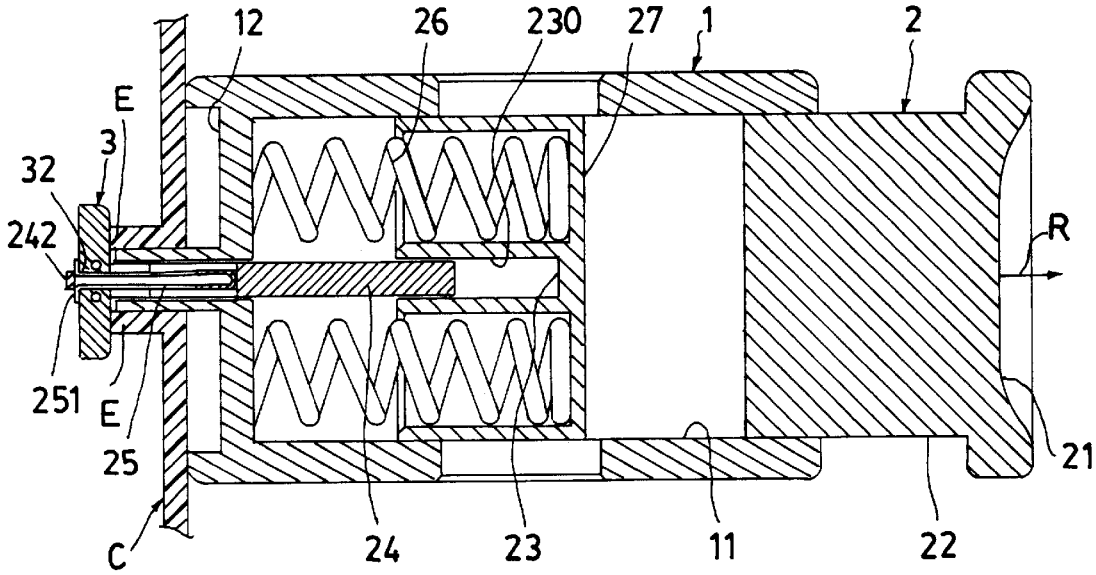
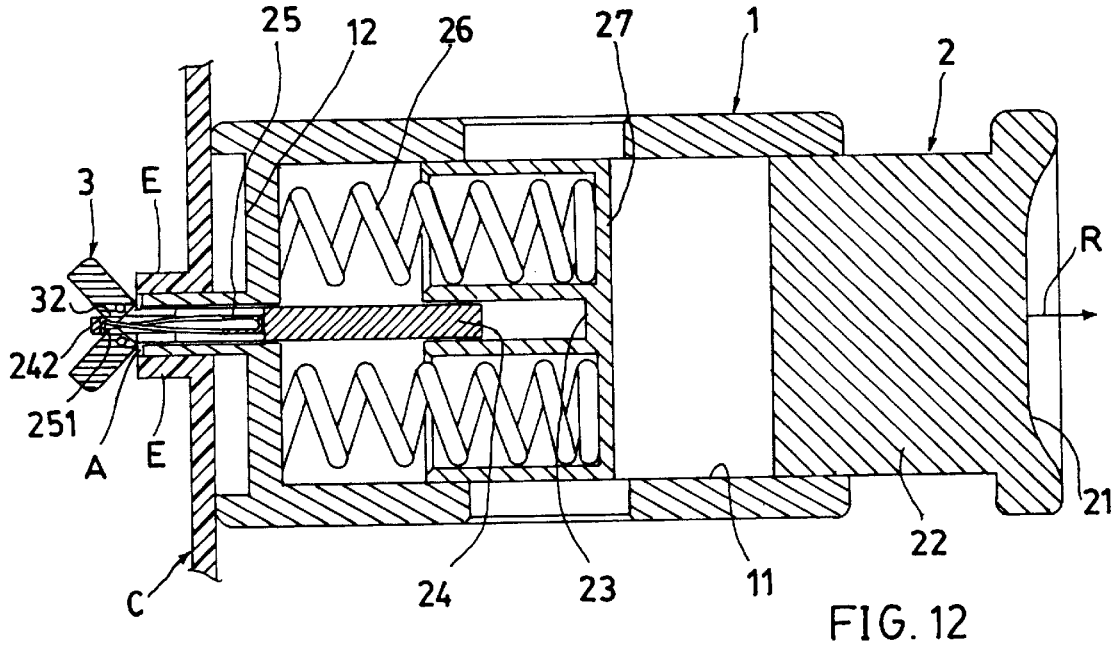
FIG. 12

COMPUTER LOCK HAVING DOUBLE LOCKING LEAVES

BACKGROUND OF THE INVENTION

U.S. Pat. No. 5,327,752 to Myers et al. disclosed a computer equipment lock having an axial pin tubular lock for use in securing portable computers having spindle-accepting port. However, the T-shaped head portion (76) on the cylindrical neck portion (77) should be rotated at a right angle to be retarded by the slotted port in the computer for locking the computer. For withdrawing the head portion (76) from the computer, it should be further rotated to be aligned with the computer slot in order to unlock the computer. Such a rotation of the head portion (76) of the spindle is inconvenient for the users especially for those disabled computer operators.

Meanwhile, such a prior art should be provided with suitable apertures allowing the free rotation of the spindle head (76) for locking or unlocking purpose, e.g., an aperture existing among the extensive members **(82*a*, 82*b*), the side wall of the computer slot and the spindle head (76); or an aperture existing in the computer slot since the spindle head (76)** when locked is perpendicular to the computer slot without fully closing or shielding the computer slot; with these apertures rendering the opportunities for unexpected intrusion for unlocking the computer equipment lock, thereby decreasing its security effect.

The present inventor has found the drawbacks of the conventional computer equipment lock and invented the present computer lock having double locking leaves.

SUMMARY OF THE INVENTION

The object of the present invention is to provide a computer lock including a housing (1) having a pair of locking leaves (3) respectively pivotally secured on a front end portion of the housing (1) with the two locking leaves (3) combinably flattened to be inserted through a computer slot (A), and an actuating device (2) slidably held in the housing (1) to be locked in the housing, whereby upon a forward pushing of the actuating device (2) to openly bias the two locking leaves (3) for extending the two leaves (3) to be retarded against the sidewall extension disposed around the computer slot, the computer will then be stably locked with the two locking leaves (3) of the computer lock.

BRIEF DESCRIPTION OF THE DRAWINGS

FIG. 5 shows a first step for forwarding (P) the actuating means for locking the present invention (following FIG. 3).

FIG. 6 shows a partial opened locking leaves following FIG. 5.

FIG. 11 shows further retraction of the actuating means following FIG. 10.

FIG. 12 shows the step for combinably flattening the two locking leaves for unlocking the present invention following FIG. 11.

DETAILED DESCRIPTION

Figure 1:
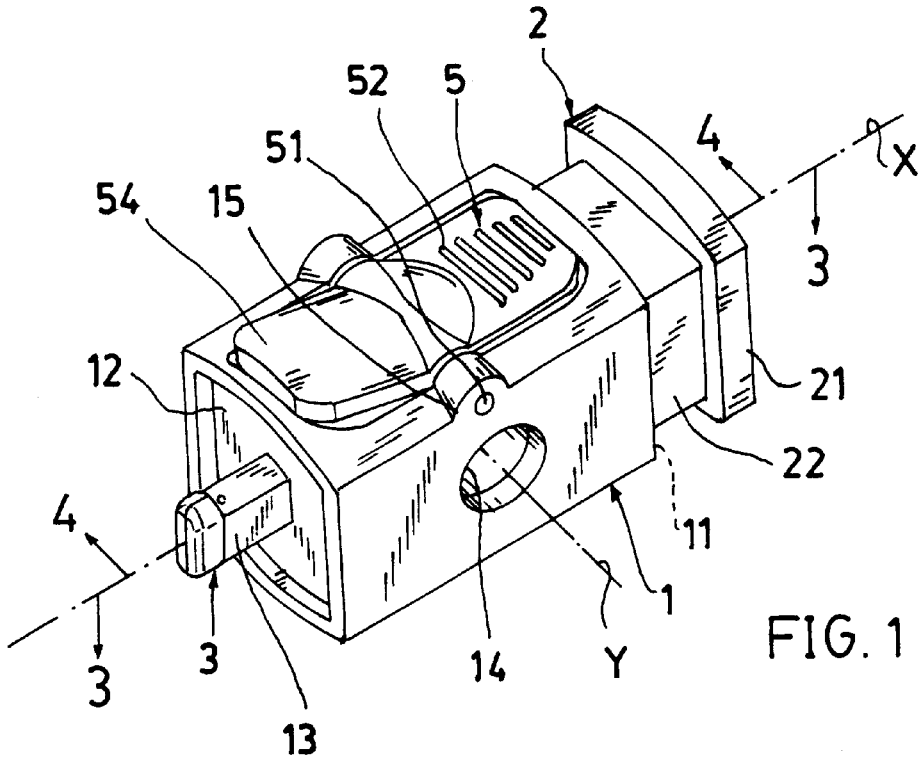
FIG. 1 is a perspective view of the present invention when not locked.
Figure 2:
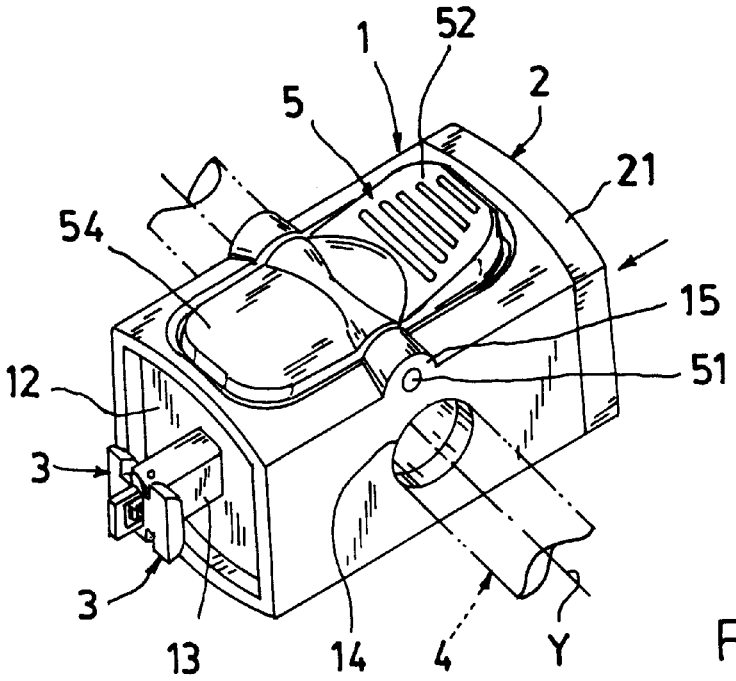
FIG. 2 is a perspective view of the present invention when locked.

As shown in FIGS. 1~13, the present invention comprises: a housing 1, an actuating means 2 slidably held in the housing 1, a pair of locking leaves 3 respectively pivotally secured on a front portion of the housing 1, a locking member 4 of an auxiliary lock 41 passing through the housing 1 and the actuating means 2 for retarding the retraction of the actuating means 2 when locked, and a control button 5 for releasing and unlocking the actuating means 2 when unlocked.

The housing 1 includes: a longitudinal axis X defined at a longitudinal center of the housing, an inside hole 11 longitudinally formed in the housing 1 for slidably holding the actuating means 2 in the inside hole 11, an end plate 12 formed on an inner portion of the housing for stopping a forward movement of the actuating means 2 slidably held in the housing 1, a sleeve portion 13 protruding forwardly from the end plate 12 having the pair of locking leaves 3 pivotally secured on a front end portion of the sleeve portion 13, a locking slot 14 transversely formed through the housing 1 defining a latitudinal axis Y perpendicular to the longitudinal axis X for passing a locking member 4 of an auxiliary lock 41 through the locking slot 14 as shown in FIGS. 2, 8, 9 and 13, a pivot holder 15 formed on a top portion of the housing 1 for pivotally mounting the control button 5 on the housing 1, and a stopping pin 16 transversely fixed in the housing 1 for limiting a rearward retraction of the actuating means 2 for preventing the releasing of the actuating means 2 from the housing 1 (FIG. 4) when unlocked.

Figure 9:
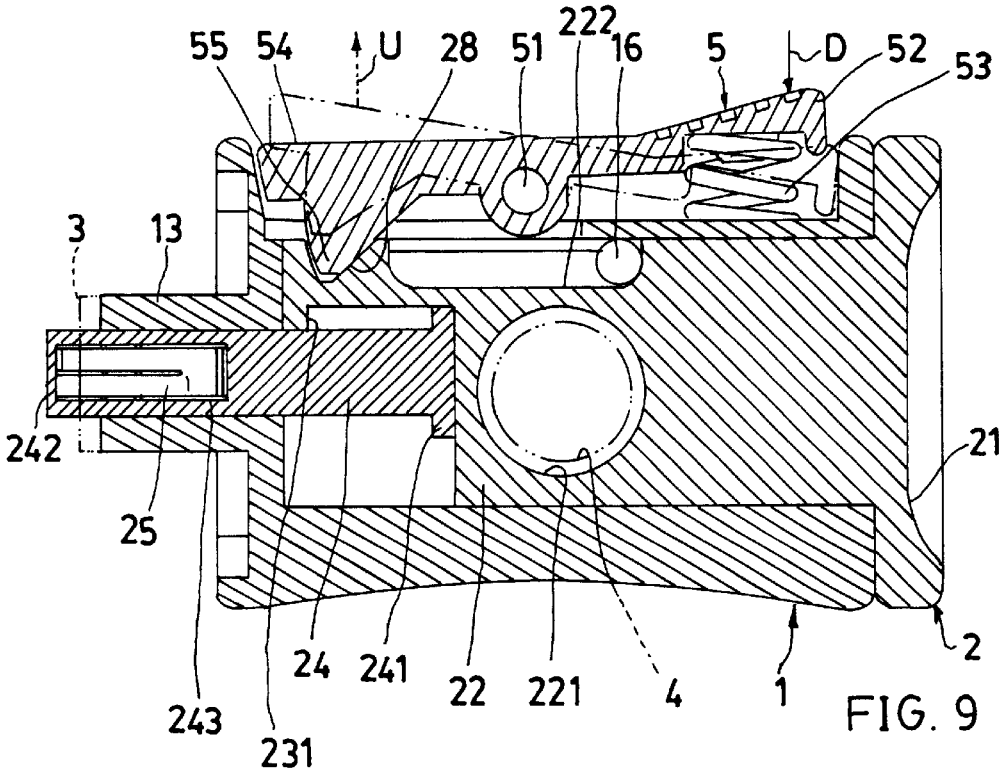
FIG. 9 shows the step ready for unlocking the present invention.
Figure 10:
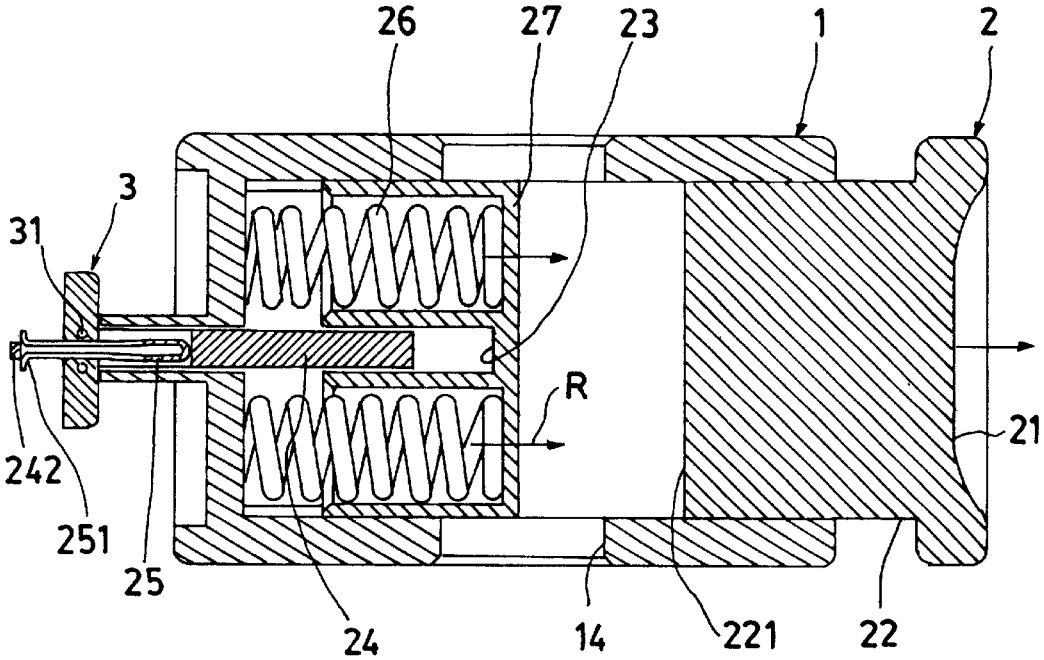
FIG. 10 shows the initial step for retracting the actuating means for unlocking the present invention.

The actuating means 2 includes: a knob portion 21 secured with a plunger portion 22 slidably engageable with the inside hole 11 of the housing 1, a holding base 23 formed on a retaining plate 27 formed on a front portion of the plunger portion 22, a pushing member 24 slidably held in a socket 230 formed in the holding base 23, a spring link 25 held in a hollow portion 243 formed in the pushing member 24, at least a restoring spring 26 (or two springs 26 as shown in the figures) resiliently retained between the end plate 12 and the retaining plate 27 for normally retracting the actuating means 2 rearwardly when unlocked, and a tooth recess 28 recessed in an upper front portion of the plunger portion 22 to be engaged with a ratchet tooth 55 of the control button 5 when locked (FIG. 9).

The plunger portion 22 is formed with a locking hole 221 transversely formed through the plunger portion 22 and aligned with the locking slot 14 transversely formed through the housing 1 when locked; and formed with a sliding groove 222 longitudinally in the plunger portion 22 to be limited by the stopping pin 16 when retracting the actuating means 2 rearwardly when unlocked.

Figure 8:
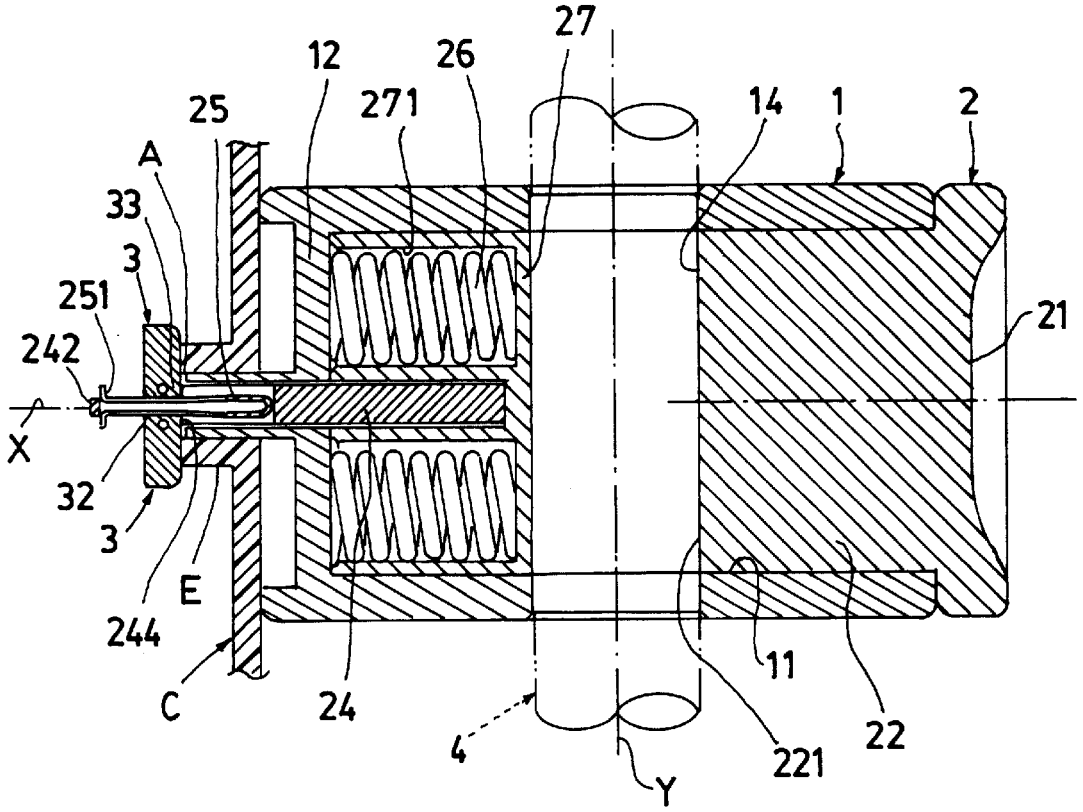
FIG. 8 shows the fully opened locking leaves for locking the present invention.

The pushing member 24 includes: a bottom end portion 241 engageable with a pulling extension 231 of the holding base 23 for pulling the pushing member 24 rearwardly when unlocking the lock, a front end portion 242 formed on a front end of the pushing member 24 for extensibly biasing the two locking leaves 3 when intended to be locked in a slot A of a computer C, a hollow portion 243 formed in a front portion of the pushing member 24 for storing the spring link 25 in the hollow portion 243, and a shoulder portion 244 formed in a front portion of the pushing member 24 adjacent to the front end portion 242 for stopping the retraction of the two locking leaves 3 as opened and locked on a side-wall extension E disposed around the slot A of the computer C (FIG. 8).

The spring link 25 includes: a U-shaped base 250 formed on a bottom portion of the link 25 and retained in the socket 230 in the holding base 23, and a pair of hook portions 251 formed on two bifurcated front ends of the U-shaped base 250 for pulling the two locking leaves 3 for closing the two locking leaves 3 when retracting the actuating means 2 for unlocking the lock (FIGS. 11, 12).

Each restoring spring 26 has its rear end retained in a spring socket 271 formed on the retaining plate 27, and has a front end of the spring 26 retained against the end plate 12 of the housing 1.

The pair of locking leaves 3 are respectively pivotally mounted on a front end portion of the sleeve portion 13 of the housing by a pair of pins 31. Each locking leaf 3 has a driving portion 32 positioned adjacent to the other driving portion 32 of the other locking leaf 3 and operatively rotating about the pin 31, whereby upon a forward pushing by the front end portion 242 of the pushing member 24, the driving portion 32 of the locking leaf 3 will be forwardly rotatably biased around the pin 31 when pushing (P) the knob portion 21 of the actuating means 2 forwardly for locking the lock of the present invention (FIG. 6) until opening the two locking leaves 3; and an angled portion 33 formed on the other side of the pin 31 opposite to the driving portion 32 and adapted to be rested upon the shoulder portion 244 of the pushing member 24 when the locking leaf 3 is opened and locked on the side-wall extension E around the slot A of the computer C and on the shoulder portion 244 as shown in FIG. 8.

Figure 13:
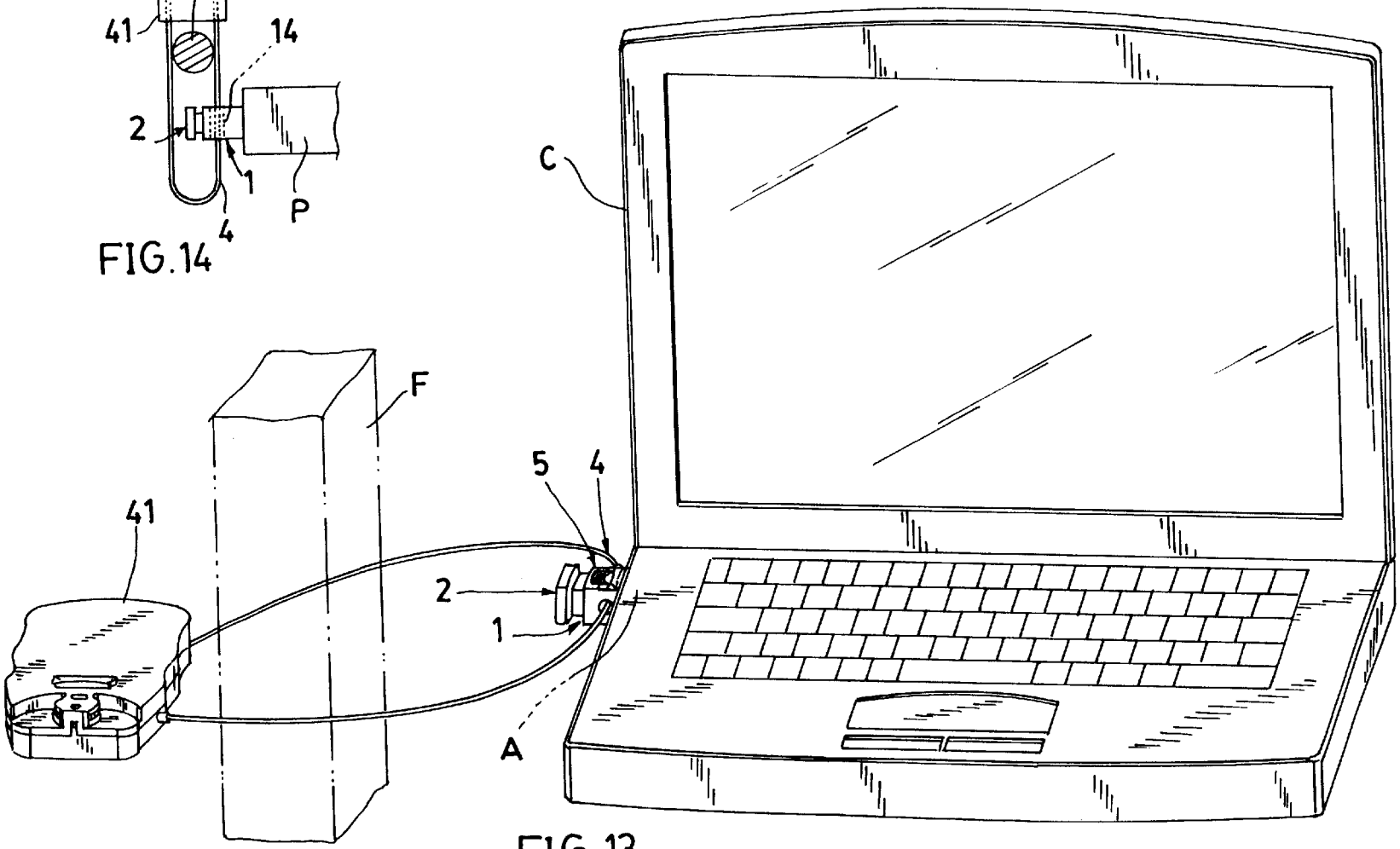
FIG. 13 is an illustration showing the locking of a computer with the present invention.
Figure 14:
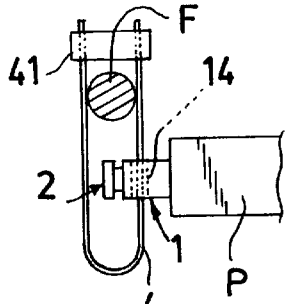
FIG. 14 shows another application for locking a computer with the present invention.

The locking member 4 may be a wire 4 of a wire lock of the auxiliary lock 41 as shown in FIG. 13; or the locking member 4 may be a shackle or a bolt 4 of a lock or a padlock of the auxiliary lock 41 as shown in FIG. 14, not limited in the present invention. The lock 41 may be fastened to a fixture or any fixed object F for safely locking the computer C.

The control button 5 as shown in FIGS. 1, 2, 4 and 9 includes: a pivot 51 for seesawly mounting the control button 5 on a pivot holder 15 on the housing 1, a push button 52 formed on a rear end portion of the control button 5, a button restoring spring 53 retained on the housing for normally urging the push button 52 upwardly, a locking flap 54 formed on a front end portion of the control button 5, and a ratchet tooth (or protrusion) 55 formed on a bottom portion of the locking flap 54 for engaging a tooth recess 28 recessed in the actuating means 2 when pushed forwardly and locked as shown in FIG. 9.

Figure 7:
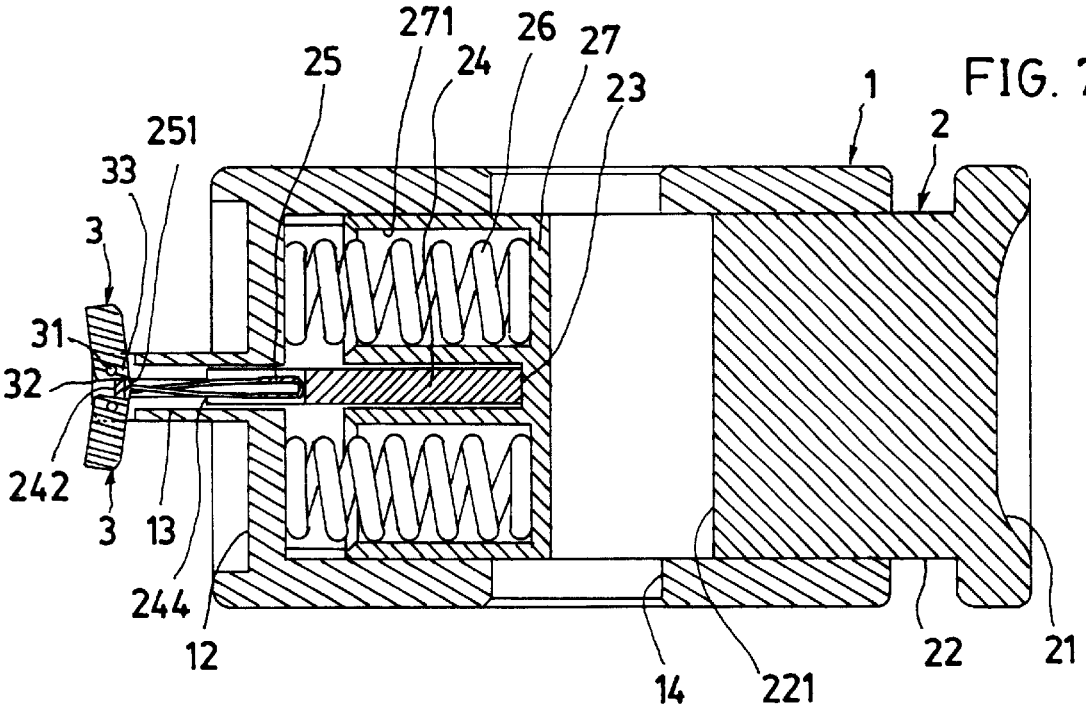
FIG. 7 shows almost fully opened locking leaves following FIG. 6.

When using the present invention for locking a computer C such as a personal computer or any other computer equipments, the actuating means 2 is pushed forwardly (P) from FIGS. 5, 6 to allow the front end portion 242 of the pushing member 24, backed on the holding base 23 of the actuating means 2, to push the driving portion 32 of each locking leaf 3 for opening or extending the two locking leaves 3 about the two pins 31; whereby the front end portion 242 and the two hook portions 251 of the spring link 25 will still be pushed forwardly (with the two hook portions 251 compressed each other to be "narrower") to pass through an aperture between the two leaves 3 as shown in FIGS. 7, 8; and whereby the two leaves 3 will be fully "opened" and extended to be retarded on the shoulder portion 244 of the pushing member 24 and on the extension E of the slot A of the computer C. The area of the two locking leaves 3, when opened for locking purpose, should be equal to or larger than the area of the computer slot A.

The locking member 4 (wire, bolt or shackle of the lock 41) is inserted through the slot 14 of the housing 1 and through the hole 221 of the actuating means 2 as shown in FIGS. 8, 9 for locking the lock of the present invention for fastening the lock of this invention to a fixture or fixed object F as shown in FIGS. 13, 14.

Figure 3:
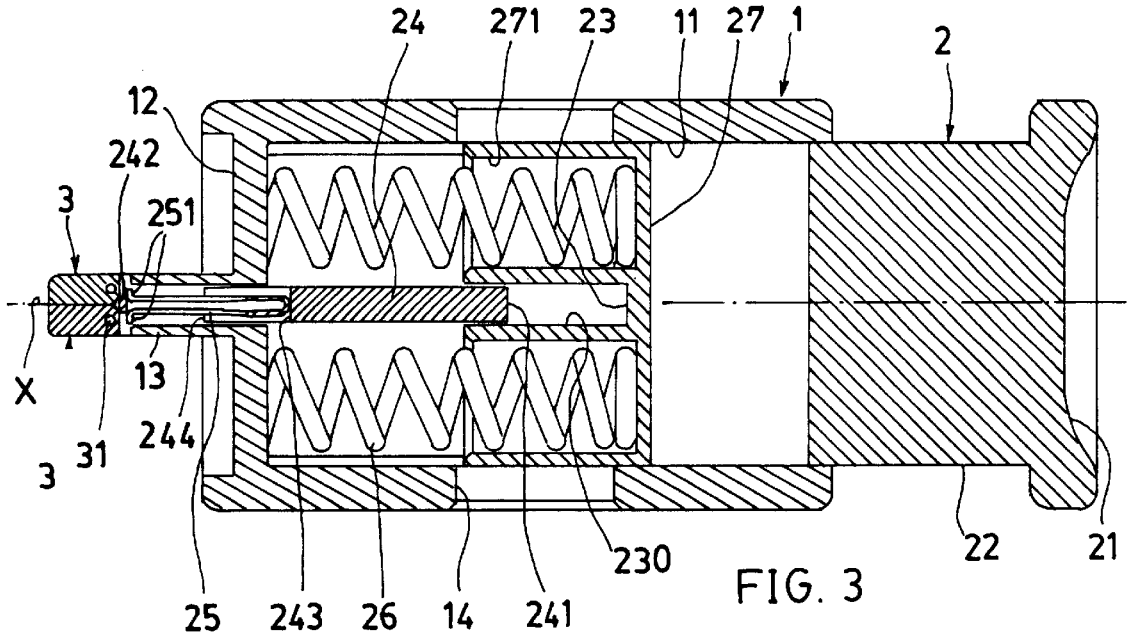
FIG. 3 is a cross sectional drawing of the present invention when viewed from direction 3—3 of FIG. 1.
Figure 4:
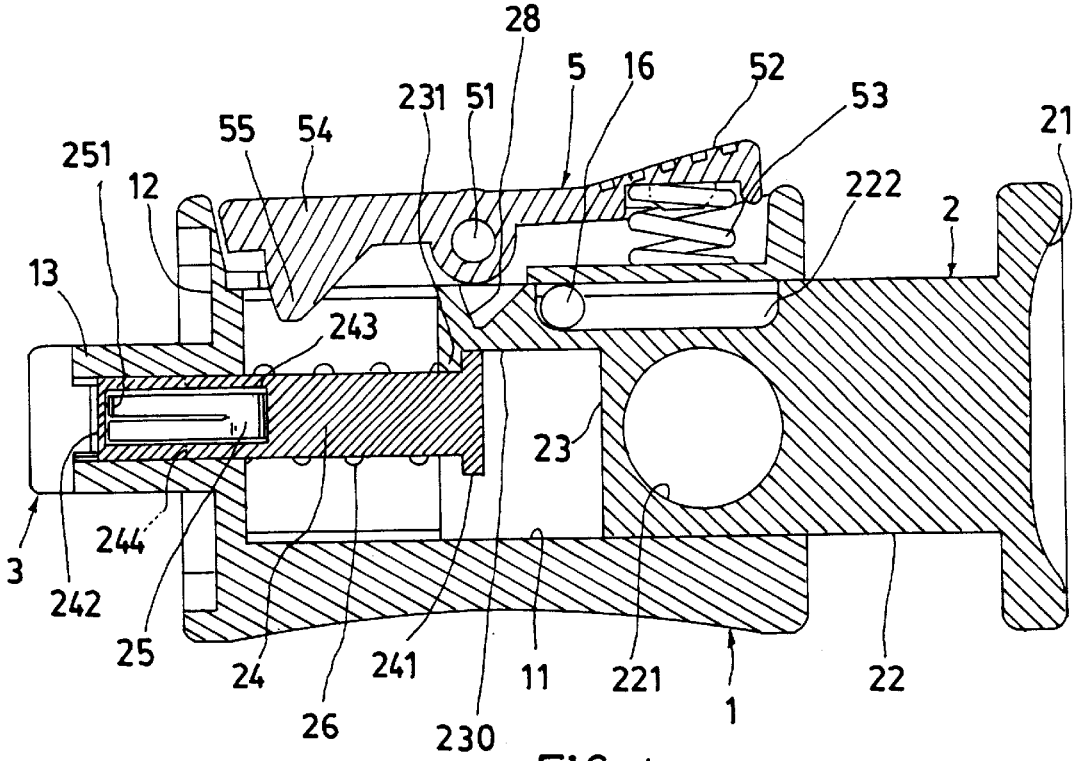
FIG. 4 is a longitudinal sectional drawing of the present invention when viewed from 4—4 direction of FIG. 1.

For unlocking the present invention as shown in FIGS. 9, 10, 11 and 12, the locking member 4 is released from the slot 14 and hole 221 by unlocking the auxiliary lock 41; and the push button 52 is depressed (D) to lift (U) the ratchet tooth or protrusion (55) to disengage the tooth 58 from the recess 28, the restoring springs 26 will urge the retaining plate 27 rearwardly to retract (R) the actuating means 2, whereby the two hook portions 251 of the spring link 25 will pull the two locking leaves 3 (FIG. 12) to bias the leaves 3 in a counter direction for "closing" the two leaves 3 to be combinably "flattened" as shown in FIGS. 4, 3 in order to pass (and to be withdrawn) through the slot A of the computer C to unlock the present invention.

Accordingly, the present invention is superior to the conventional prior arts with the following advantages:

1. For locking the computer with the lock of the present invention, just straightly push the actuating means 2 forwardly without any turning action about the axis X, especially being convenient for those disabled computer operators.
2. The pair of locking leaves 3, once inserted into the computer slot A, can be "opened" or extended to be stably locked on the slot side-wall extension E, providing a symmetric and balancing force distribution when locking the present invention with the computer equipments for a firm efficient locking purpose and also for safely protecting the computer equipment (housing) by minimizing the damage to the side-wall of the computer slot A due to such a symmetric and balancing force (stress) distribution of the two leaves on the computer housing.
3. The two locking leaves 3 of this invention, when opened to be locked on the side wall of the computer slot A, will completely shield or close the computer slot A without leaving any aperture for allowing unexpected intrusion for unlocking the computer lock. Meanwhile, the two opened locking leaves are stably firmly retained (or locked) against the side wall of the computer slot for locking the computer more efficiently than any prior art in this field.

The present invention may be modified without departing from the spirit and scope of this invention.

I claim:

1. A computer lock comprising:

a housing (1) having a control button (5) seesawly pivotally mounted thereon;

an actuating means (2) slidably held in said housing (1); and a pair of locking leaves (3) respectively pivotally secured in a front end portion of said housing (1); said pair of locking leaves (3) normally combinably flattened to be inserted through a slot of a computer or the like; and said pair of locking leaves (3) operatively extended, as biased by said actuating means (2) when forwardly pushed, to be retarded and locked on a side wall of the slot of the computer for locking the computer; whereby upon depression on a push button (52) of the control button (5), said actuating means (2) will be unlocked and retracted rearwardly for unlocking the computer lock.

2. A computer lack according to claim 1, wherein said housing (1) further includes a locking member (4) of an auxiliary lock (41) operatively locking said actuating means (2) to a fixture when locked as forwardly pushed; whereby upon unlocking of said auxiliary lock (41) to withdraw said locking member (4) from said housing (1), said actuating means (2) is unlocked.

3. A computer lock according to claim 2, wherein said locking member (4) includes: a wire, a bolt, and a shackle.

4. A computer lock according to claim 2, wherein said auxiliary lock (41) includes: a wire lock and a padlock.

5. A computer lock according to claim 1, wherein said housing (1) includes: a longitudinal axis (X) defined at a longitudinal center of the housing, an inside hole (11) longitudinally formed in the housing (1) for slidably holding the actuating means (2) in the inside hole (11), an end plate (12) formed on an inner end of the housing for stopping a forward movement of the actuating means (2) slidably held in the housing (1), a sleeve portion (13) protruding forwardly from the end plate (12) having the pair of locking leaves (3) pivotally secured on a front end portion of the sleeve portion (13), a locking slot (14) transversely formed through the housing (1) defining a latitudinal axis (Y) perpendicular to the longitudinal axis (X) for passing a locking a member (4) of an auxiliary lock (41) through the locking slot (14), a pivot holder (15) formed on a top portion of the housing (1) for pivotally mounting a control button (5) on the housing (1), and a stopping pin (16) transversely fixed in the housing (1) for limiting a rearward retraction of the actuating means (2) for preventing the releasing of the actuating means (2) from the housing (1) when unlocked.

6. A computer lock according to claim 5, wherein said actuating means (2) includes: a knob portion (21) secured with a plunger portion (22) slidably engageable with the inside hole (11) of the housing (1), a holding base (23) formed on a retaining plate (27) formed on a front portion of the plunger portion (22), a pushing member (24) slidably held in a socket (230) formed in the holding base (23), a spring link (25) held in a hollow portion (243) formed in the pushing member (24), at least a restoring spring (26) resiliently retained between the end plate (12) and the retaining plate (27) for normally retracting the actuating means (2) rearwardly when unlocked, and a tooth recess (28) recessed in an upper front portion of the plunger portion (22) to be engaged with a ratchet tooth (55) of the control button (5) when locked.

7. A computer lock according to claim 6, wherein said plunger portion (22) is formed with a locking hole (221) transversely formed through the plunger portion (22) and aligned with a locking slot (14) transversely formed through the housing (1) when locked; and formed with a sliding groove (222) longitudinally in the plunger portion (22) to be limited by the stopping pin (16) when retracting the actuating means (2) rearwardly when unlocked.

8. A computer lock according to claim 6, wherein said pushing member (24) includes: a bottom end portion (241) engageable with a pulling extension (231) of the holding base (23) for pulling the pushing member (24) rearwardly when unlocking the computer lock, a front end portion (242) formed on a front end of the pushing member (24) for extensibly biasing the two locking leaves (3) when intended to be locked in a slot of a computer, a hollow portion (243) formed in a front portion of the pushing member (24) for storing the spring link (25) in the hollow portion (243), and a shoulder portion (244) formed in a front portion of the pushing member (24) adjacent to the front end portion (242) for stopping the retraction of the two locking leaves (3) as opened and locked on a side-wall extension disposed around the slot of the computer.

9. A computer lock according to claim 6, wherein said spring link (25) includes: a U-shaped base (250) formed on a bottom portion of the spring link (25) and retained in the socket (230) formed in the holding base (23), and a pair of hook portions (251) formed on two bifurcated front ends of the U-shaped base (250) for pulling the two locking leaves (3) for closing the two locking leaves (3) when retracting the actuating means (2) for unlocking the computer lock.

10. A computer lock according to claim 8, wherein each said locking leaf (3) has a driving portion (32) positioned adjacent to a driving portion (32) of another locking leaf (3) and each said leaf (3) operatively rotating about the pin (31), whereby upon a forward pushing by the front end portion (242) of the pushing member (24), the driving portion (32) of the locking leaf (3) will be forwardly rotatably biased around the pin (31) when pushing the knob portion (21) of the actuating means (2) forwardly for locking the computer lock until opening the two locking leaves (3); and an angled portion (33) formed on the other side of the pin (31) opposite to the driving portion (32) and adapted to be rested upon the shoulder portion (244) of the pushing member (24) when the locking leaf (3) is opened and locked on the side-wall extension around the slot of the computer and on the shoulder portion (244) of said pushing member (24).

11. A computer lock according to claim 1, wherein said control button (5) includes: a pivot (51) for seesawly mounting the control button (5) on a pivot holder (15) on the housing (1), said push button (52) formed on a rear end portion of the control button (5), a button restoring spring (53) retained on the housing for normally urging the push button (52) upwardly, a locking flap (54) formed on a front end portion of the control button (5), and a ratchet tooth (55) formed on a bottom portion of the locking flap (54) for engaging a tooth recess (28) recessed in the actuating means (2) when locked.

* * * * *